US007335058B1

(12) United States Patent
Burris et al.

(10) Patent No.: US 7,335,058 B1
(45) Date of Patent: Feb. 26, 2008

(54) SNAP-FIT CONNECTOR ASSEMBLY

(75) Inventors: Donald Andrew Burris, Peoria, AZ (US); William Bernard Lutz, Glendale, AZ (US)

(73) Assignee: Corning Gilbert, Inc., Glendale, AZ (US)

( * ) Notice: Subject to any disclaimer, the term of this patent is extended or adjusted under 35 U.S.C. 154(b) by 0 days.

(21) Appl. No.: 11/637,564

(22) Filed: Dec. 13, 2006

(51) Int. Cl.
*H01R 9/05* (2006.01)

(52) U.S. Cl. ..... 439/578; 439/353

(58) Field of Classification Search ..... 439/578, 439/353, 357, 583, 584
See application file for complete search history.

(56) References Cited

U.S. PATENT DOCUMENTS

| | | | | |
|---|---|---|---|---|
| 5,147,221 | A * | 9/1992 | Cull et al. | 439/585 |
| 5,741,159 | A * | 4/1998 | Wright | 439/668 |
| 5,975,951 | A | 11/1999 | Burris et al. | 439/585 |
| 6,089,903 | A * | 7/2000 | Stafford Gray et al. | 439/439 |
| 6,290,538 | B1 | 9/2001 | Pocrass | 439/578 |
| 6,736,674 | B2 * | 5/2004 | Korte et al. | 439/578 |
| 6,786,757 | B2 | 9/2004 | Pocrass | 439/418 |
| 6,790,081 | B2 | 9/2004 | Burris et al. | 439/578 |
| 6,824,403 | B2 * | 11/2004 | Hall et al. | 439/108 |
| 6,955,563 | B1 | 10/2005 | Croan | 439/578 |
| 7,018,235 | B1 | 3/2006 | Burris et al. | 439/584 |
| 7,021,964 | B1 | 4/2006 | Croan | 439/578 |
| 7,189,114 | B1 * | 3/2007 | Burris et al. | 439/578 |
| 7,214,095 | B1 * | 5/2007 | Mathews | 439/578 |
| 2003/0068924 | A1 * | 4/2003 | Montena | 439/578 |
| 2004/0209516 | A1 * | 10/2004 | Burris et al. | 439/587 |
| 2004/0266258 | A1 * | 12/2004 | Stirling | 439/578 |
| 2005/0260890 | A1 * | 11/2005 | Holland | 439/578 |
| 2006/0068634 | A1 * | 3/2006 | Petersen et al. | 439/578 |
| 2006/0178047 | A1 * | 8/2006 | Croan | 439/578 |

* cited by examiner

*Primary Examiner*—Tulsidas C. Patel
*Assistant Examiner*—Vladimir Imas
(74) *Attorney, Agent, or Firm*—Joseph M. Homa; Matthew J. Mason

(57) ABSTRACT

A coaxial connector assembly is disclosed herein for coupling a coaxial cable to a port. The coaxial connector assembly includes a connector member, a post, a locking member, and an adapter. The post comprises a shank and a post flange. The shank and the connector member are configured to be capable of sandwiching at least part of the cable so that the connector member grips the cable. The locking member comprises at least one forward extending resilient arm. The front portion of the adapter is configured to engage the port, and the back portion of the adapter is configured to receive the connector member. The resilient arms are configured to snap fit into the adapter, the resilient arms preferably being capable of release from the adapter, thereby releasably attaching the connector member to the adapter.

20 Claims, 16 Drawing Sheets

SNAP-FIT CONNECTOR ASSEMBLY

BACKGROUND OF THE INVENTION

1. Field of the Invention

The present invention relates generally to connectors for coaxial cable, and more particularly to coaxial cable connectors that provide a locking arrangement between a coaxial cable and a complementary port or related terminal.

2. Technical Background

Coaxial cable connectors are used to attach a coaxial cable to another cable, as well as to a terminal, port, junction or related complementary article (collectively referred to as ports). One common form of coaxial cable connector is the F connector, a type of radio frequency (RF) coaxial connector commonly used for cable television and cable modems, among other things. Such connectors help maintain the shielding that the coaxial cable design offers, while permitting the desired connectivity to the appropriate port.

Once attached to a coaxial cable, the connector is attached to a port that, as is often the case, is incorporated into somewhat fragile electronic equipment, such as a DVD player, computer or television set. Due to the sensitive nature of such equipment, field installers are hesitant to use a wrench to tighten the connector onto the port. Also, some of the newer devices include molded-in shrouds that preclude the use of wrenches to tighten connectors. Additionally, consumers tend to disconnect equipment for relocation purposes but are not adequately trained or equipped to properly reconnect the ports. Consumers who are accustomed to quick and easy snap-fit connections as found in telephone cords can find the attachment of a cable television cable using conventional threaded couplers, such as those with traditional F connectors, burdensome. If not adequately attached to the mating port, the connectors can lead to poor signal quality.

Previous attempts to provide a quick and easy coupling system have not proven to be entirely satisfactory. Some of the devices currently in use are in the form of a push-on friction-fit interface adapted to the coaxial cable side of the junction. These interfaces use various means of sliding or pushing over the male thread typically found on the equipment port. Although functional, such interfaces suffer from certain drawbacks, including the relative ease with which the interface will pull apart. For example, when equipment is being moved or relocated, a mated pair may inadvertently become disconnected. A second problem is found when push-on interfaces are constructed to more aggressively engage the port. Since the push-on interface is not designed to utilize the port threads, but, rather, grasp over them, the push-on interface can damage the port threads during installation or withdrawal.

Other attempts to provide a quick and easy coupling system for connecting coaxial cable to electronic devices have resulted in entirely new connector interfaces. Such approaches have the disadvantage of requiring significant design changes existing to equipment infrastructure, resulting in inconvenience and expense associated with large-scale retrofitting.

SUMMARY OF THE INVENTION

A coaxial connector assembly is disclosed herein for coupling a coaxial cable to a port. The coaxial connector assembly comprises a connector member, a post, a locking member, and an adapter. The post comprises a shank and a post flange wherein the shank and post flange are preferably formed as a single piece. In partially assembled and fully compressed states, the shank is at least partially disposed inside the connector member. The shank and the connector member are configured to be capable of sandwiching at least part of the cable so that the connector member grips the cable. The post flange is disposed at least partially outside the connector member. At least part of the locking member is disposed between the post flange and the outer surface of the connector member. The locking member comprises at least one forward extending resilient arm and preferably at least two forward extending resilient arms. The front portion of the adapter is configured to engage the port, and the back portion of the adapter is configured to receive the connector member. The resilient arms are configured to snap fit into the adapter, the resilient arms preferably being capable of release from the adapter, thereby releasably attaching the connector member to the adapter.

In one aspect, a coaxial connector assembly is disclosed herein for coupling a coaxial cable to a port. The assembly comprises: a connector member; a post comprising a shank and a flange, the shank at least partially disposed inside the connector member, the shank being configured for insertion into the cable, wherein the shank and the connector member are capable of sandwiching the cable, and the flange being disposed outside the connector member; a locking member disposed between the flange and the outer surface of the connector member, the locking member comprising at least two forward extending resilient arms; and an adapter comprising an internal surface defining a through hole extending from the front end to the back end of the adapter, wherein the front portion of the adapter is configured to engage the port, and the back portion of the adapter is configured to receive the connector member, wherein the resilient arms are configured to snap fit into the adapter, thereby releasably attaching the connector member to the adapter.

In another aspect, a combination of a coaxial cable and a coaxial connector assembly is disclosed for coupling the coaxial cable to a port, the coaxial cable comprising a center conductor. The assembly comprises a connector member, a post comprising a shank and a flange, a locking member, and an adapter. The shank is inserted into the cable, and at least part of the shank is disposed inside the connector member, wherein at least part of the cable is sandwiched between the shank and the connector member, thereby securing the cable to the connector member. The flange is disposed outside the connector member, wherein the center conductor of the cable protrudes forwardly beyond the flange. The locking member is disposed between the flange and the outer surface of the connector member, the locking member comprising at least one pair of opposed forward extending resilient arms, wherein the center conductor of the cable protrudes through the locking member; and an adapter comprising a front portion, a back portion, an external surface, and an internal surface defining a through hole extending from the front end to the back end of the adapter; wherein the front portion of the adapter is configured to engage the port, wherein the connector member is received in the back portion of the adapter, and wherein the resilient arms are snap fit onto the adapter, thereby releasably attaching the connector member to the adapter.

BRIEF DESCRIPTION OF THE DRAWINGS

The following detailed description of specific embodiments of the present invention can be best understood when read in conjunction with the following drawings, where like structure is indicated with like reference numerals and in which.

DETAILED DESCRIPTION OF THE PREFERRED EMBODIMENT

Figure 1:
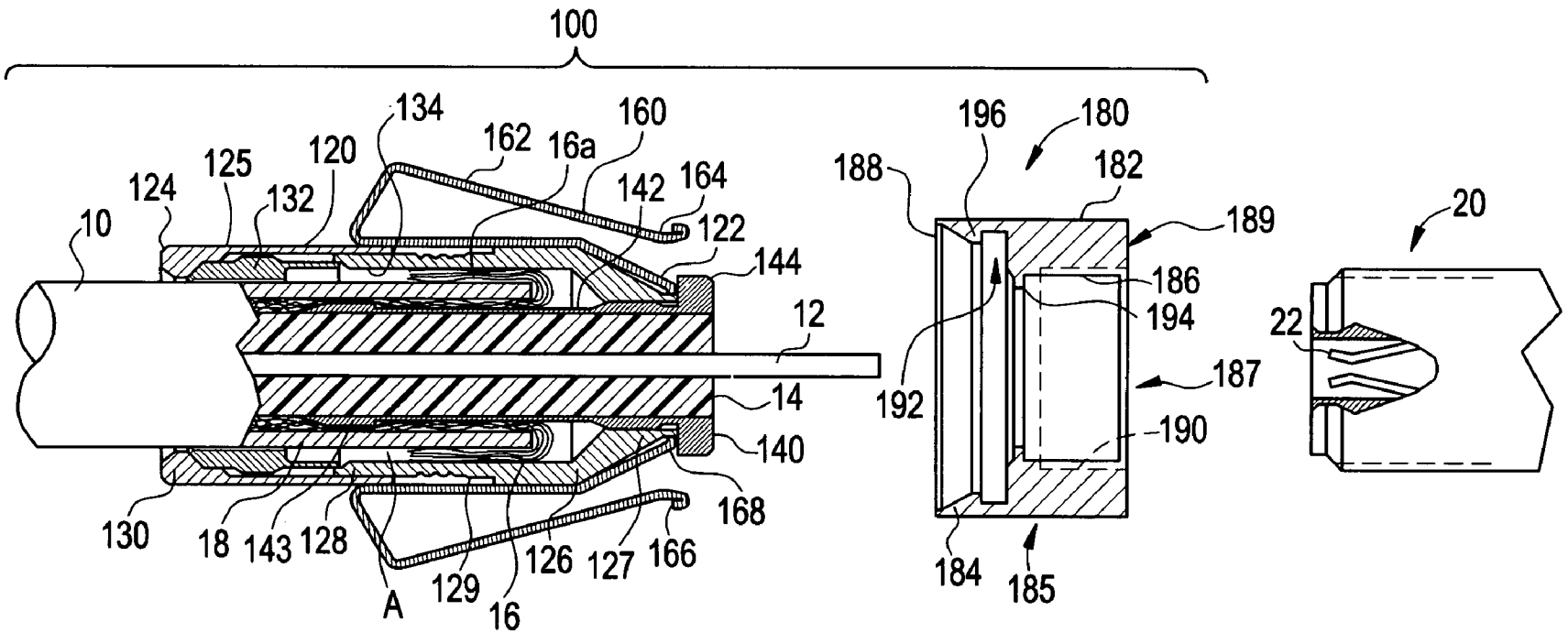
FIG. 1 is an exploded view of a connector assembly according to a first embodiment of the present invention, as well as an equipment port to which the assembly may be coupled, the connector member and adapter being shown in cross-section, and the cable and the post being shown in partial cross-section, the connector member not fully compressed.

FIG. 1 shows a coaxial connector assembly 100 for coupling a coaxial cable 10 to a port 20. A coaxial cable 10 typically comprises a center conductor 12 surrounded by a dielectric 14 surrounded by an outer conductor 16, which may be a metal foil, a metal wire braid, or both. The outer conductor 16 is typically surrounded by a jacket 18, for example comprised of a plastic material. A known port 20 typically comprises a center portion 22 that receives the center conductor 12 of the cable 10, thereby electrically connecting the center portion 22 of the port 20 and the center conductor 12 of the cable 10.

As illustrated by the embodiment shown in FIG. 1, the coaxial connector assembly 100 comprises a connector member 120, a post 140, a locking member 160, and an adapter 180. The connector member 120 comprises a front end 122, a back end 124, and an outer surface 125. The post 140 comprises a shank 142 and a post flange 144. In partially assembled and fully compressed states, the shank 142 is at least partially disposed inside the connector member 120. The shank 142 is configured for insertion into the cable 10, and in some embodiments, the shank 142 is configured for insertion between a dielectric 14 and an outer conductor 18 of the cable 10. For example, the wedge shaped back end 143 can be inserted into the cable 10 such that the braid 16 of the cable surrounds at least part of the shank 142. The shank 142 and the connector member 120 are configured to be capable of sandwiching at least part of the cable 10, thereby gripping the cable and securing the connector member to the cable. The connector member 120 comprises a tubular body 126. The tubular body 126 comprises a front end 127, a back end 128, and an outer surface 129.

The post flange 144 is disposed at least partially outside the connector member 120. At least part of the locking member 160 is disposed between the post flange 144 and the outer surface 125 of the connector member 120. In some embodiments, the locking member 160 is a spring clip. The locking member 160 comprises at least one, preferably at least two, forward extending resilient arms. In some embodiments, the at least two forward extending resilient arms comprise at least one pair of opposed forward extending resilient arms 162, such as shown in FIG. 1. The adapter 180 comprises a front portion 182, a back portion 184, an external surface 185, and an internal surface 186 defining a through hole 187 extending from the front end 189 to the back end 188 of the adapter 180. The front portion 182 of the adapter 180 is configured to engage the port 20, and the back portion 184 of the adapter 180 is configured to receive the connector member 120. The resilient arms 162 are configured to snap fit into the adapter 180, preferably being capable of release from the adapter 180, thereby releasably attaching the connector member 120 to the adapter 180. The locking member 160 is trapped between the post flange 144 and the connector member 120.

The locking member 160 shown in FIG. 1 contacts the connector member 120. In some embodiments, the locking member 160 comprises electrically conductive material, thereby providing an electrical path from the connector member 120 to the adapter 180.

The post 140 is provided with a through hole configured to allow a center conductor 12 of the cable 10 to protrude through the post 140 and beyond the post flange 144. The inner surface of the post 140 that defines the through hole can have a constant diameter circular cross-section throughout the entire length of the post.

The adapter 180 is configured to threadably engage the port 20, for example by a threaded portion 190. In FIG. 1, the internal surface 186 of the adapter 180 is provided with threads.

In the installed position, the locking member 160 and the adapter 180 can contact each other to form an electrical path between the outer surface 125 of the connector body 126 and an outer surface of the port 20 provided that the connector outer body is electrically conductive. An outer conductor path is provided from the cable outer conductor 16 to the post 140, and in some embodiments the post 140 and locking member 160 may be coupled to provide, or form, an electrical path to the adapter 180 and port 20.

In some embodiments such as shown in FIG. 1, the internal surface 186 of the adapter 180 is provided with an internal recess 192 configured to receive at least one of the resilient arms 162. The resilient arms 162 are biased radially outwardly and engage the internal surface 186 of the adapter 180, thereby inhibiting disengagement between the connector member 120 and the adapter 180. In the embodiment shown in FIG. 1, the distal ends 164 of the resilient arms 160 comprise lips 166 configured to releasably engage the internal recess 192.

In some embodiments such as shown in FIG. 1, the adapter 180 comprises a projection which limits the extent of axial mating of the connector member 120 and the adapter 140, for example the internal surface 186 of the adapter 180 is provided with an inwardly radial projection 194, such as an annular flange, configured to engage the connector member 120, thereby limiting advancement of the connector member 120 into the adapter 180. In some embodiments, such as shown in FIG. 1, the inwardly radial projection 194 is configured to engage the post flange 144.

The internal surface 186 of the adapter 180 can be provided with an inward projection configured to engage the port 20, thereby limiting advancement of the port 20 into the adapter 180. Annular flange 194 can serve as such a stop.

The connector member 120 shown in the embodiment of FIG. 1 comprises a tubular body 126, a tubular compression body 130, and a tubular gripping member 132 disposed inside the compression body. By "tubular" as used herein, we mean generally tubular as defined by a body with an outer surface and an inner surface, the inner surface defining a through hole, such that the inner surface, or the outer surface, or both, may comprise various contours or shapes which are not limited to constant diameter. As seen in FIG. 1, the post 140 has been driven into the cable 10 under the braid 16. The front portion 16A of the braid 16 has been folded back over the jacket 18, and the front portion 16A of the braid 16 is disposed in the annular space A between the cable jacket 18 and the internal surface 134 of the body 126 of the connector member 120. In some embodiments, the post 140 is fixedly attached to the body 126. The compression body 130 surrounds and engages the rear end of the body 126. In the embodiment shown, the gripping member 132 comprises a forward portion that contacts the tubular body 126 in the uncompressed state.

Figure 2:
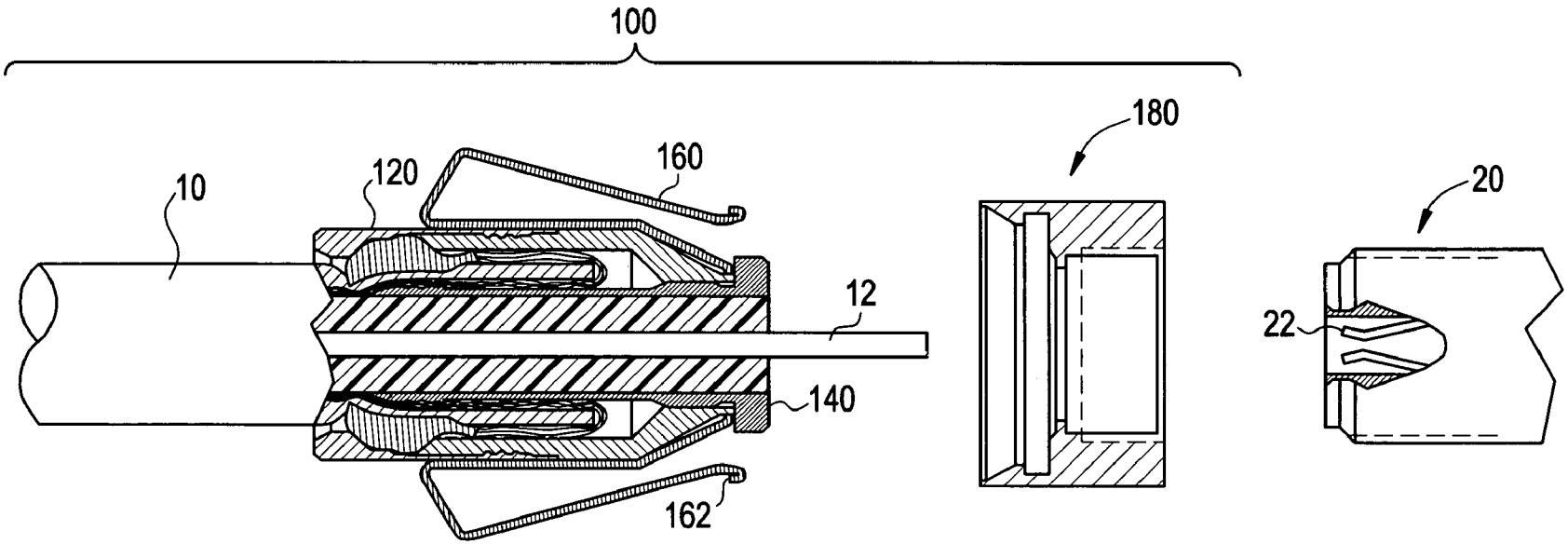
FIG. 2 is the connector assembly of FIG. 1 with the connector member fully compressed.

FIG. 2 shows the connector member 120 of FIG. 1 in a fully compressed state, i.e. after the compression body 130 and the tubular body 126 are moved relatively toward each other. Upon such axial compression, the gripping member 132 is driven radially inwardly and inside the tubular body 126, thereby causing the braid 16 and the jacket 18 to be sandwiched between the rear end of the post 140 and the gripping member 132, i.e. the connector member. Thus, the cable 10 is gripped by the connector member 120 and the connector member 120 is secured to the cable 10.

Figure 3:
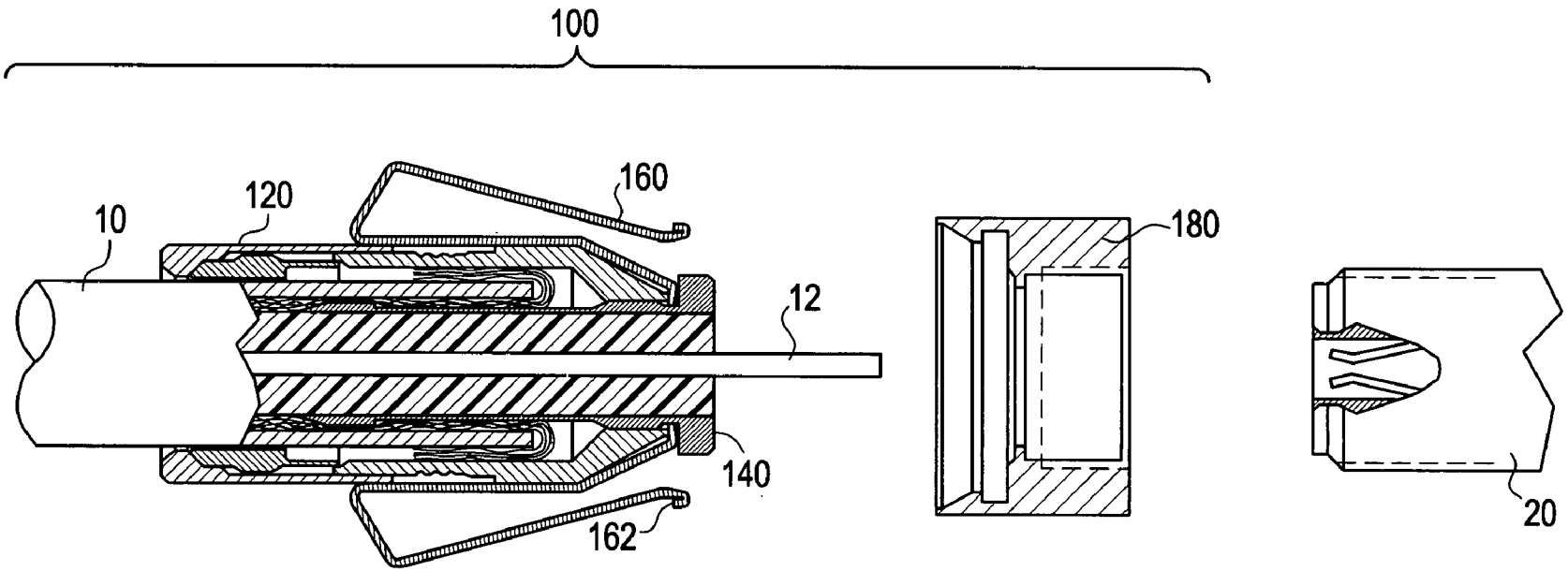
FIG. 3 shows a connector assembly and exploded view wherein the locking member is trapped between the post flange and the connector member.

FIGS. 1 and 2 show a locking member 160 having a front portion 168 provided with a through hole, and the shank 142 of the post 140 and the part of the tubular body 126 extend through the front portion 168 of the locking member 160. In some embodiments, the locking member 160 does not directly contact the post 140. FIG. 3 shows a locking member 160 having a front portion 168 provided with a through hole, and the shank 142 of the post 140 extends through the front portion 168 of the locking member 160, but the tubular body 126 does not extend through the through hole. The locking member 160 is trapped between the post flange 144 and the connector member 120. In some embodiments, part of the locking member 160 is sandwiched between the post flange 144 and the tubular body 126, such as the front end of the tubular body 126. In some embodiments, the connector member 120 does not contact the post flange 144.

In some embodiments, the locking member 160 is rotatably disposed around a portion of the connector member 120. In other embodiments, the locking member 160 is fixedly attached to the connector member 120.

Figure 4:
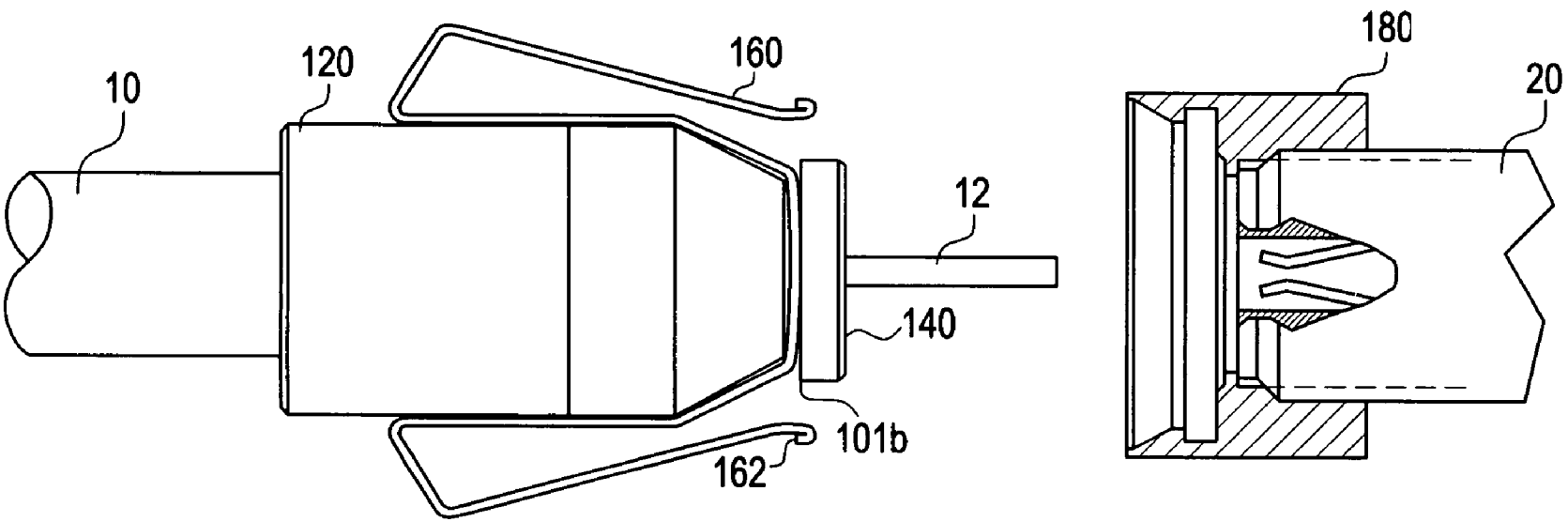
FIG. 4 shows the connector assembly of FIGS. 1 and 2 in the fully compressed state and the adapter mounted on the port.
Figure 5:
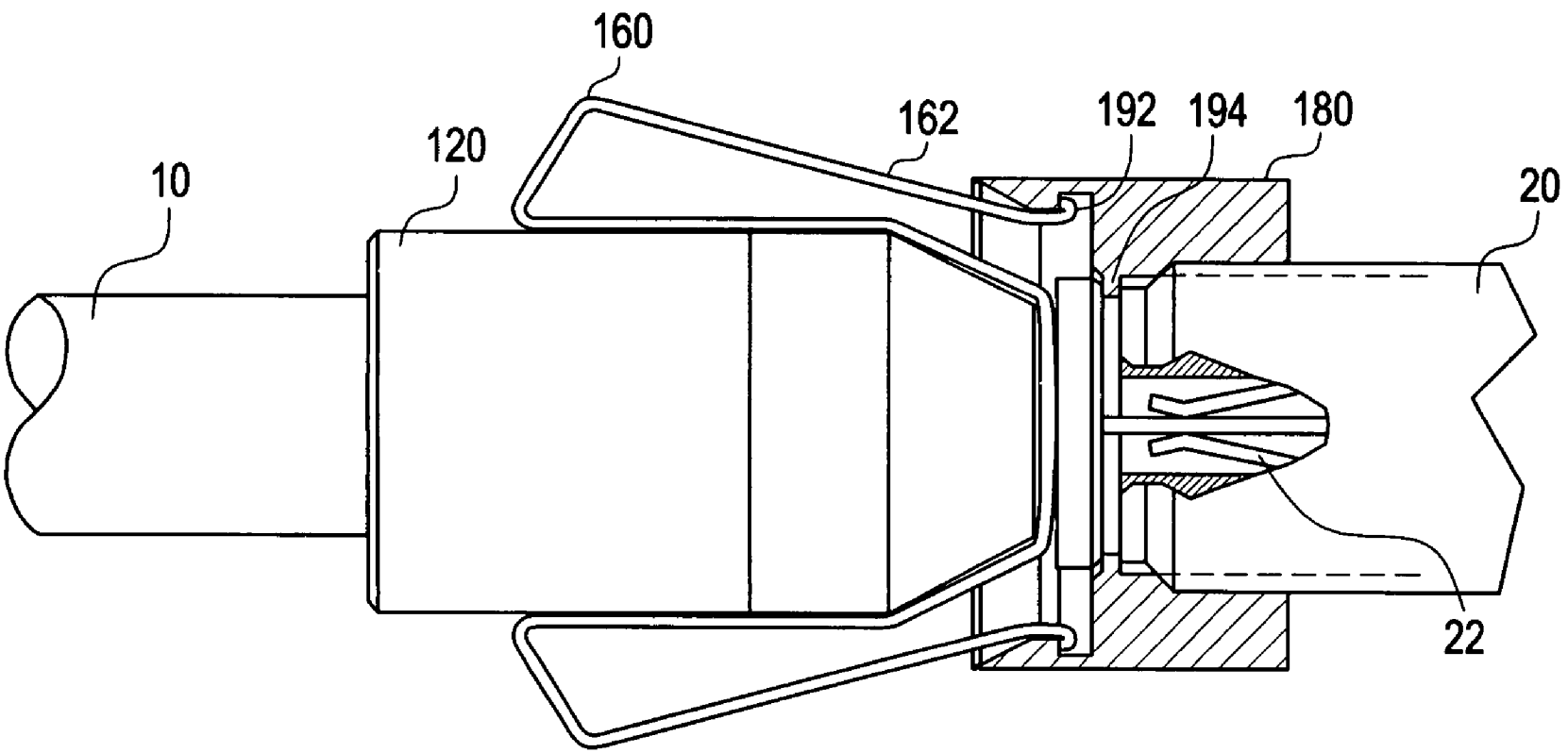
FIG. 5 shows the connector assembly of FIGS. 1, 2, and 4 in the fully assembled state with a front portion of the resilient arms disposed in the adapter.

FIG. 4 shows the connector member 120 of FIGS. 1 & 2 in the fully compressed state, and the adapter 180 is threadedly mounted on the port 20. FIG. 5 shows the connector member 120 of FIGS. 1, 2 & 4 in the fully assembled state, wherein a front portion of the resilient arms 162 are disposed in the internal recess 192 of the adapter 180 and the center conductor 12 of the cable 10 is received by the center portion 22 of the port 20. FIG. 5 shows an embodiment of an adapter 180 having an inwardly radial projection 194, here an annular flange, which engages the post flange 144 in the fully assembled state, thereby serving as a stop to limit the further axial movement of the connector member 120 into the adapter 180. As shown in FIG. 5, the inwardly radial projection 194 can also serve to space the front end of the post flange 144 away from the port 20.

Figure 8:
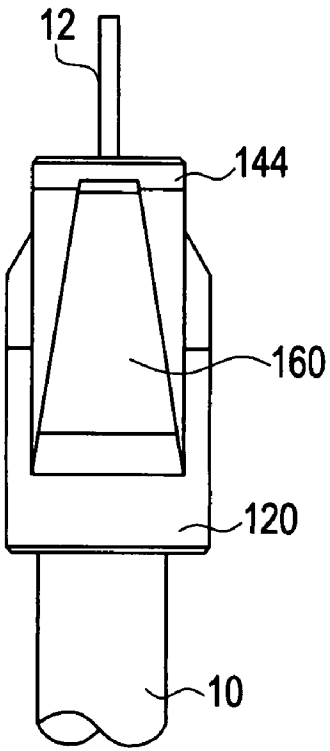
FIG. 8 is a top view of the connector assembly of FIGS. 1, 2, 4, and 5.
Figure 7:
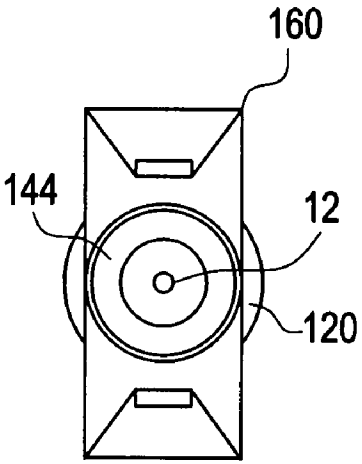
FIG. 7 is a front view of the connector assembly of FIGS. 1, 2, 4, and 5.
Figure 6:
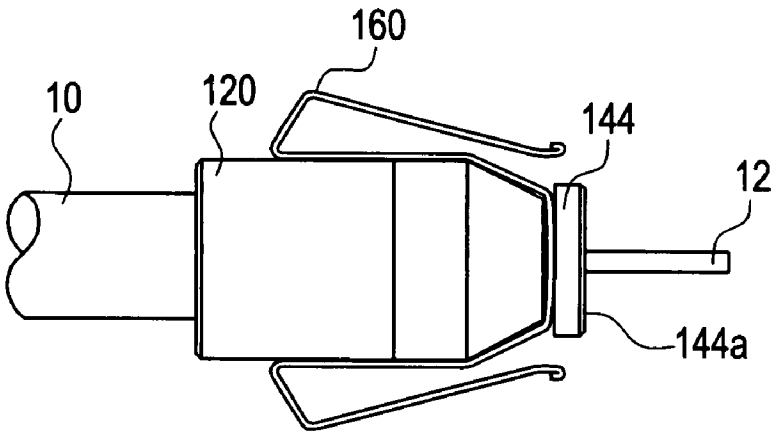
FIG. 6 is a side view of the connector assembly of FIGS. 1, 2, 4, and 5.

FIGS. 6, 7, and 8 are side, front, and top views, respectively, of the connector member 120 and locking member 160 of FIGS. 1, 2, 4, & 5 mounted on the cable 10 in a secured manner. The center conductor 12 of the cable 10 protrudes from the front end 144*a* of the post flange 144.

As can be further understood from FIGS. 1-8, the radially outwardly biased resilient arms 162 of the locking member 160 in this embodiment are adapted to be radially deflected inwardly by a force sufficient to allow the resilient arms to pass under the locking inward projection 196 of adapter 180, shown as a locking annular flange, and then to radially deflect outwardly upon release of the force, thereby causing at least part of the arms 162 to be disposed in the internal recess 192 of the adapter 180, wherein the radially outward bias of the resilient arms 162 maintains engagement between the connector member 120 and the adapter 180 and lock the connector member into engagement with the adapter, preferably releasably.

Figure 9:
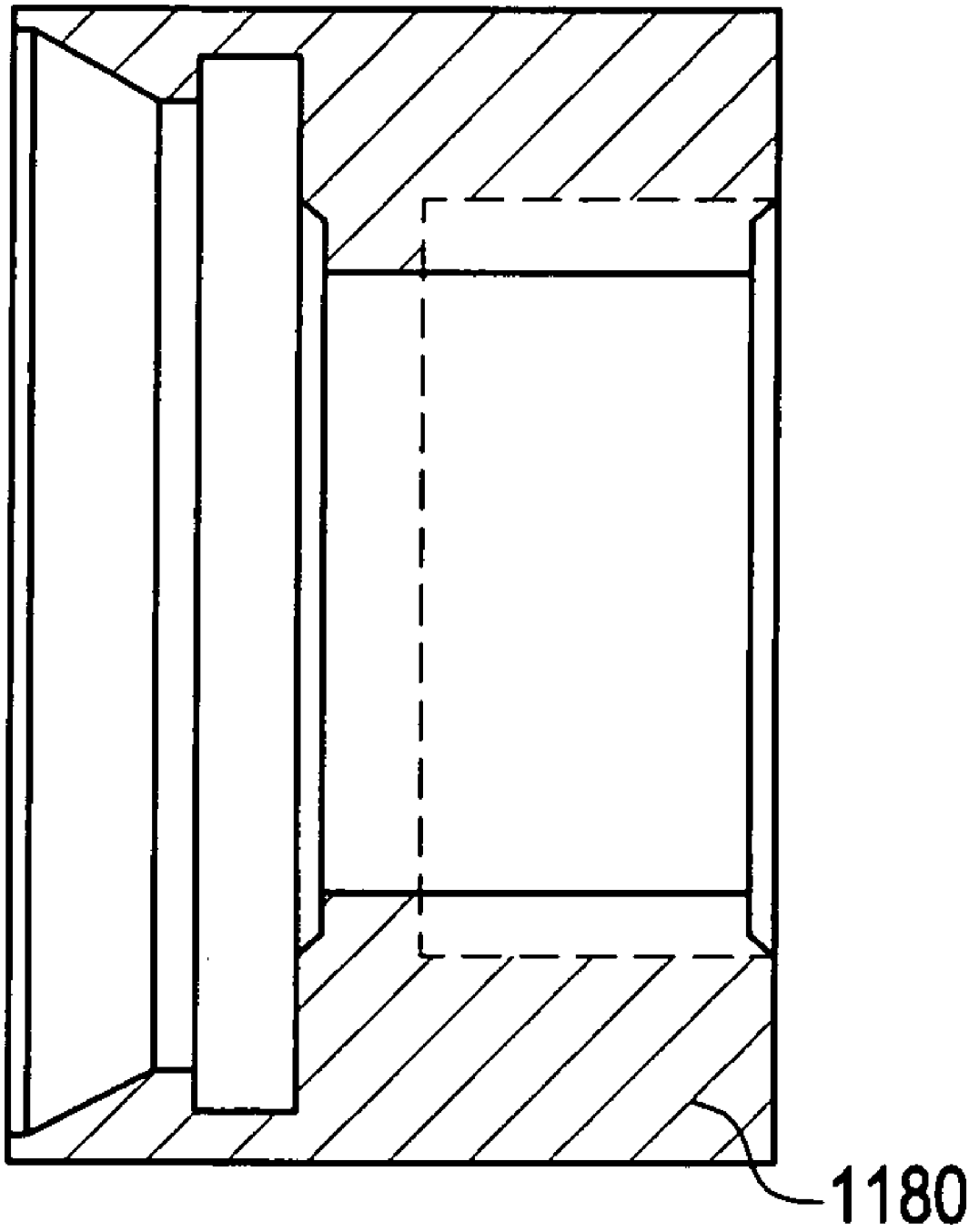
FIG. 9 is a cross-sectional view of an alternate embodiment of an adapter which has no inwardly radial projection.

FIG. 9 shows an alternate embodiment of an adapter 1180 which has no inwardly radial projection. In some embodiments, the post flange 144 contacts the port such that the port 20 limits further ingress of the connector member 120 into the adapter in the fully assembled state. In other embodiments, the locking member 160 is configured to limit further ingress of the connector member 120 into the adapter 20 in the fully assembled state.

Figure 10:
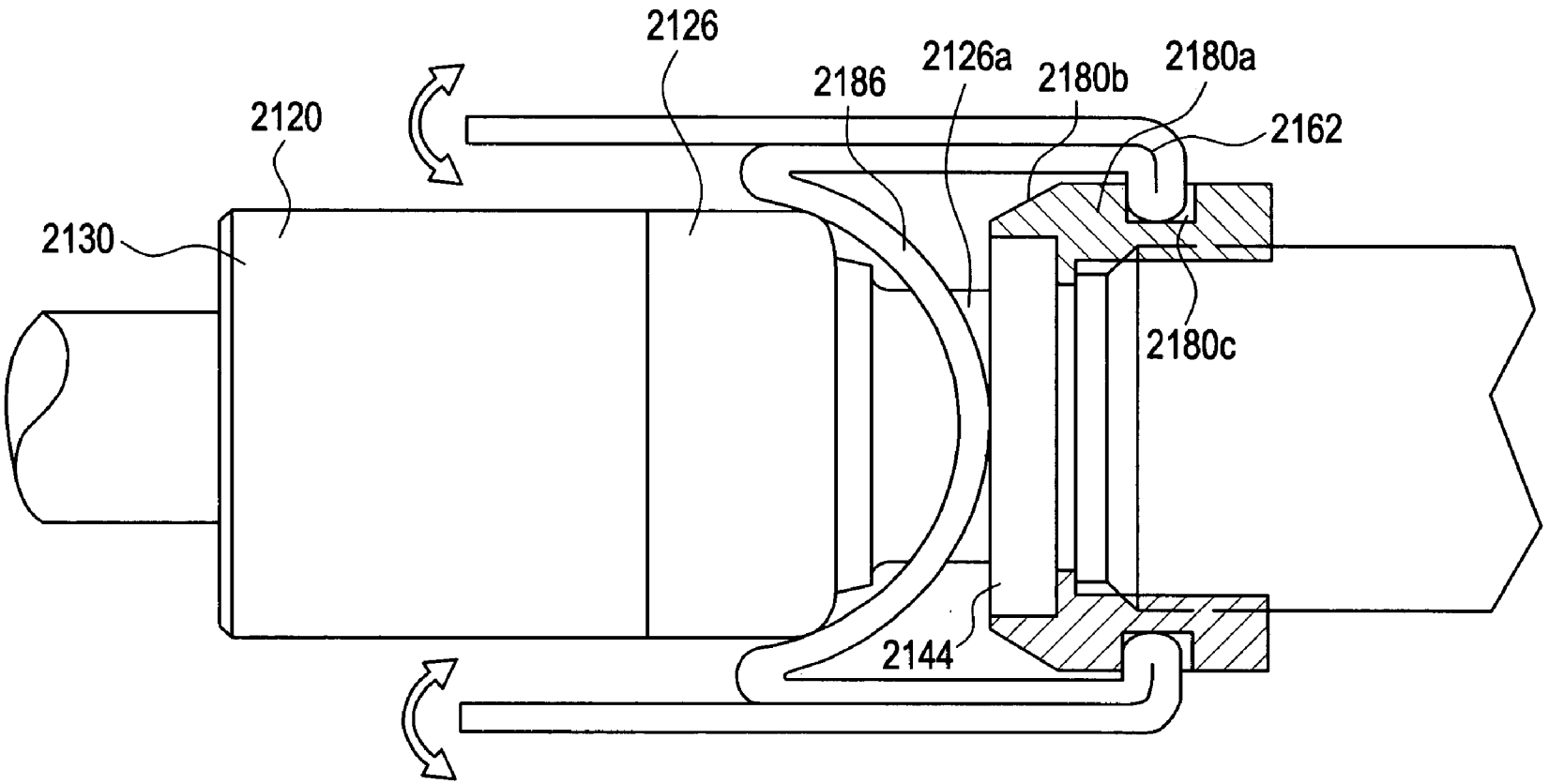
FIG. 10 shows an alternate embodiment of a connector assembly disclosed herein.
Figure 11:
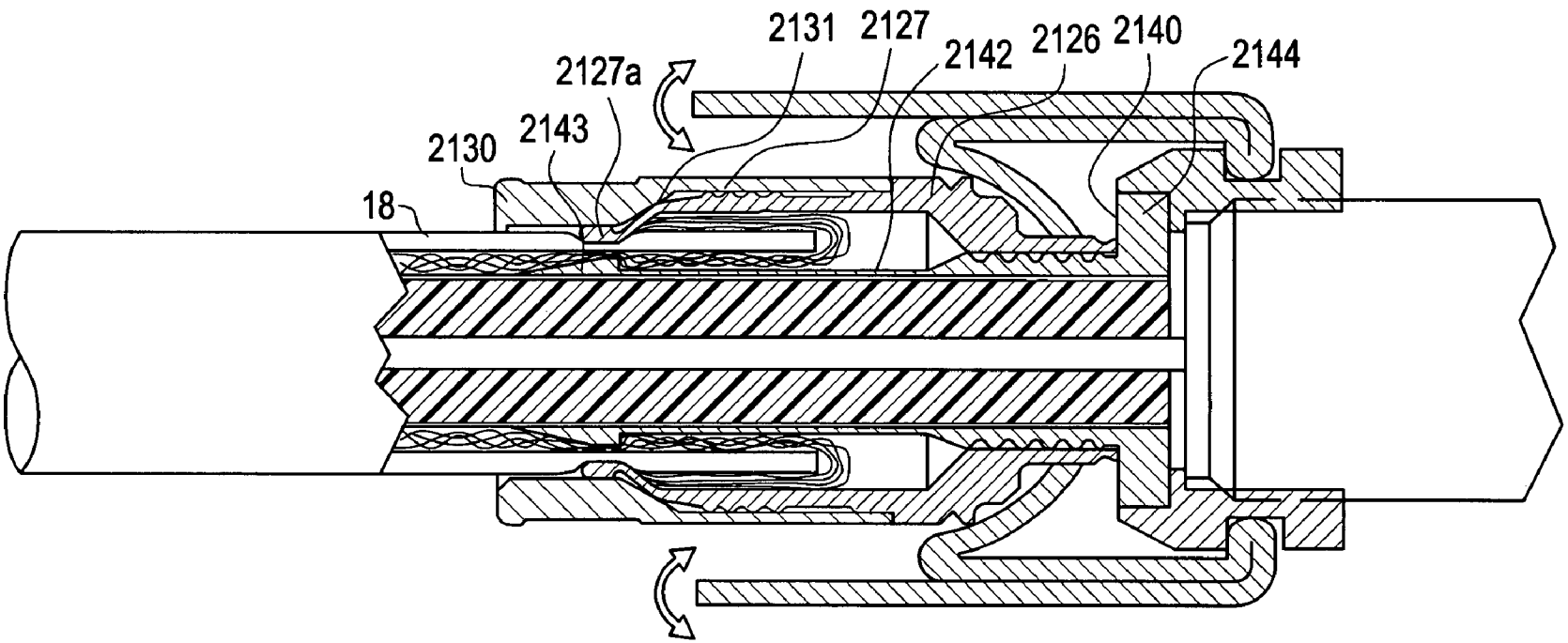
FIG. 11 shows the connector assembly of FIG. 10 in cross section.

FIGS. 10 and 11 show an alternate embodiment of a connector assembly 2100 disclosed herein. The radially inwardly biased resilient arms 2162 of the locking member 2160 in this embodiment are adapted to be radially deflected outwardly by a force sufficient to allow the resilient arms to pass over the external surface of a rear portion of the adapter 2180, the rear portion 2180*a* shown with an optional conical taper 2180*b*, and then to radially deflect inwardly upon release of the force, thereby causing the arms to be disposed in the external recess 2180*c* provided in the external surface of the adapter, wherein the radially inward bias of the resilient arms maintain engagement between the connector member 2120 and the adapter and lock the connector member into engagement with the adapter, preferably releasably. A portion 2168 of the locking member 2160 optionally contacts the outer surface of the forward neck portion 2126*a* of the tubular body 2126. At least a portion of each of the resilient arms 2162 is disposed forward of the post flange 2144.

In the embodiment shown in FIGS. 10 and 11, the connector member 2120 comprises a tubular compression body 2130 and a tubular body 2126. The tubular body 2126 comprises a rear tubular sleeve 2127 adapted to receive the cable 10, including the jacket 18. The internal surface of the compression body 2130 comprises a forward facing conical taper 2131. As seen in FIG. 11, the post 2140 has been driven into the cable 10 under the braid 16. The front portion 16*a* of the braid 16 has been folded back over the jacket 18, and the front portion of the braid is disposed in the annular space between the cable jacket and the internal surface of the sleeve of the tubular body 2126 of the connector member 2120. In some embodiments, the post 2140 is fixedly attached to the body. The compression body 2130 surrounds and engages the sleeve 2127 of the body 2126. FIGS. 10 and 11 show the connector member 2120 in a fully compressed state, i.e. after the compression body 2130 and the tubular body 2126 are moved relatively toward each other. Upon such axial compression, the conical taper 2131 of the compression body 2130 engages the tubular sleeve 2142 and causes at least part of the tubular sleeve 2127 to deform radially inwardly into contact with the cable 10, thereby causing the braid 16 and the jacket 18 to be sandwiched between the rear end of the post 2140 and the tubular sleeve 2127, i.e. the connector member. In some embodiments, the post 2140 and the sleeve 2127 are configured to cause at least part of the deformed portion 2127*a* of the sleeve to surround at least part of a raised portion 2143, such as a wedge portion, of the post, thereby compressing and gripping the jacket and the braid between the raised portion and the deformed portion. Thus, the cable is gripped by the connector member.

Figure 12:
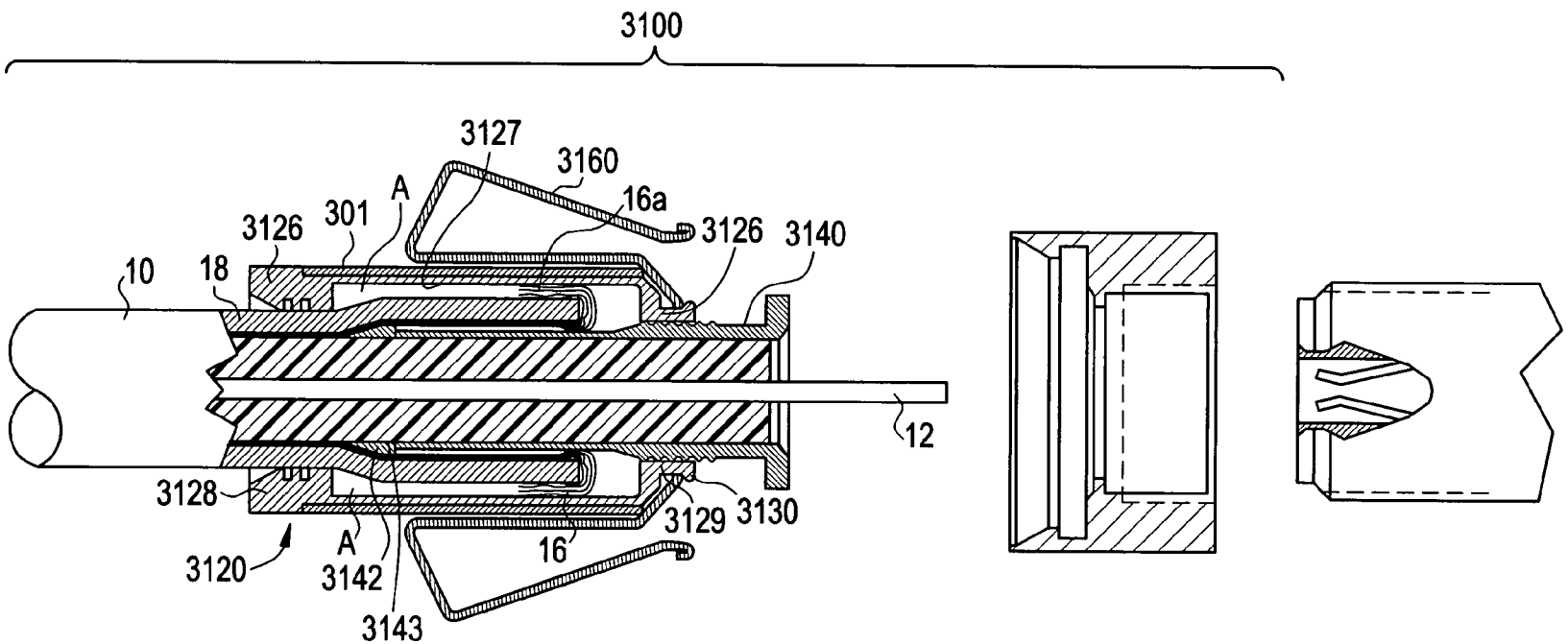
FIG. 12 shows another embodiment of a connector assembly disclosed herein.
Figure 13:
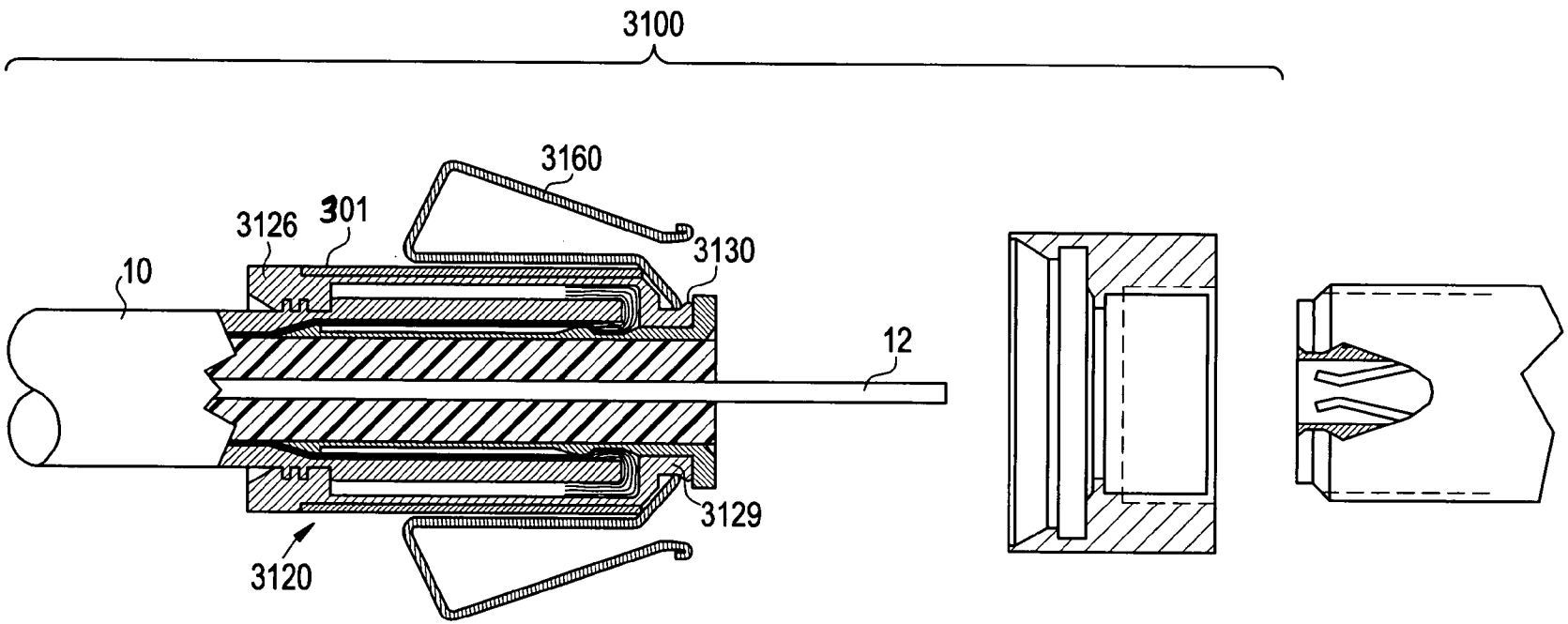
FIG. 13 shows the connector assembly of FIG. 12 with the connector member compressed.

FIGS. 12 and 13 show another embodiment of the connector assembly 3100 disclosed herein. The connector member 3120 comprises a tubular body 3126 and optionally comprises a reinforcing sleeve 301 which can be made of metal. As shown in the uncompressed state in FIG. 12, the post 3140 has been driven into the cable 10 under the braid 16. The front portion 16A of the braid 16 has been folded back over the jacket 18, and the front portion 16*a* of the braid 16 is disposed in the annular space A between the cable jacket 18 and the internal surface of the sleeve 3127 of the tubular body 3126 of the connector member 3120. In some embodiments, the post 3140 engages the forward portion of the tubular body 3126 with a light press fit, thereby allowing the post 3140 to be further inserted into the tubular body 3126 upon compressing the tubular body and the post 3140 toward each other, such as with a known compression tool. The light press fit allows the tubular body 3126 and the post 3140 to be pre-assembled and shipped in a ready cable-receiving configuration. The inner surface of the tubular body 3126 comprises a reduced diameter portion 3128 which is configured to be axially offset from the rear end 3142 of the post 3140 in the uncompressed state.

FIG. 13 shows the connector member in a fully compressed state, i.e. after the post 3140 and the tubular body 3126 are moved relatively toward each other. Upon such axial compression, the jacket and braid of the cable are sandwiched between the reduced diameter portion 3128 of the body 3126 and the tubular post 3140. In some embodiments, the post 3140 and the sleeve 3127 are configured to cause at least part of the reduced diameter portion 3128 to surround at least part of a raised portion 3143, such as a wedge portion, of the post 3140, thereby compressing and gripping the jacket and the braid between the raised portion 3143 and the reduced diameter portion 3128. Thus, the cable is gripped by the connector member.

In FIGS. 12 and 13, a portion of the locking member 3160 contacts the outer surface of the forward neck portion 3129 of the tubular body 3126. The forward neck portion 3129 of the tubular body 3126 comprises an outwardly radial projection 3130 which is configured to limit forward movement of the locking member 3160 with respect to the tubular body 3126.

Figure 14:
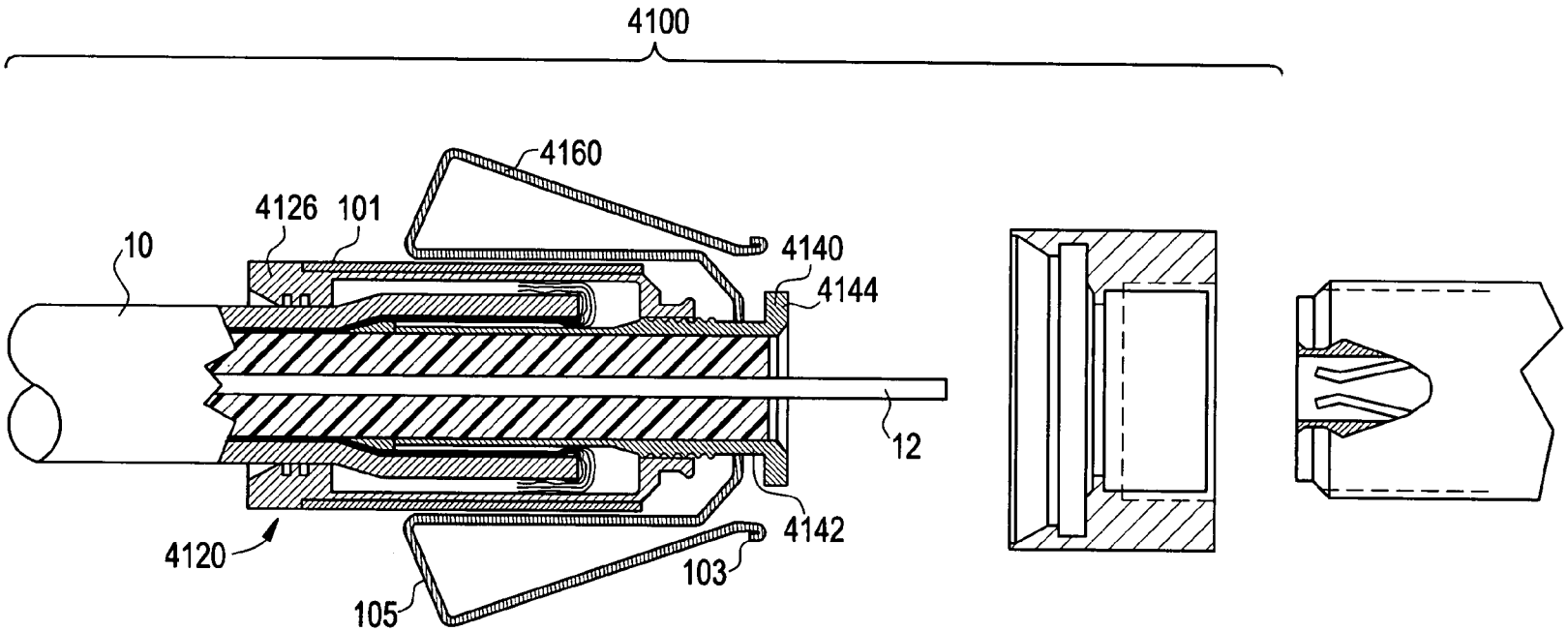
FIG. 14 shows another connector assembly disclosed herein with a locking member configured to contact the outer surface of the post.
Figure 15:
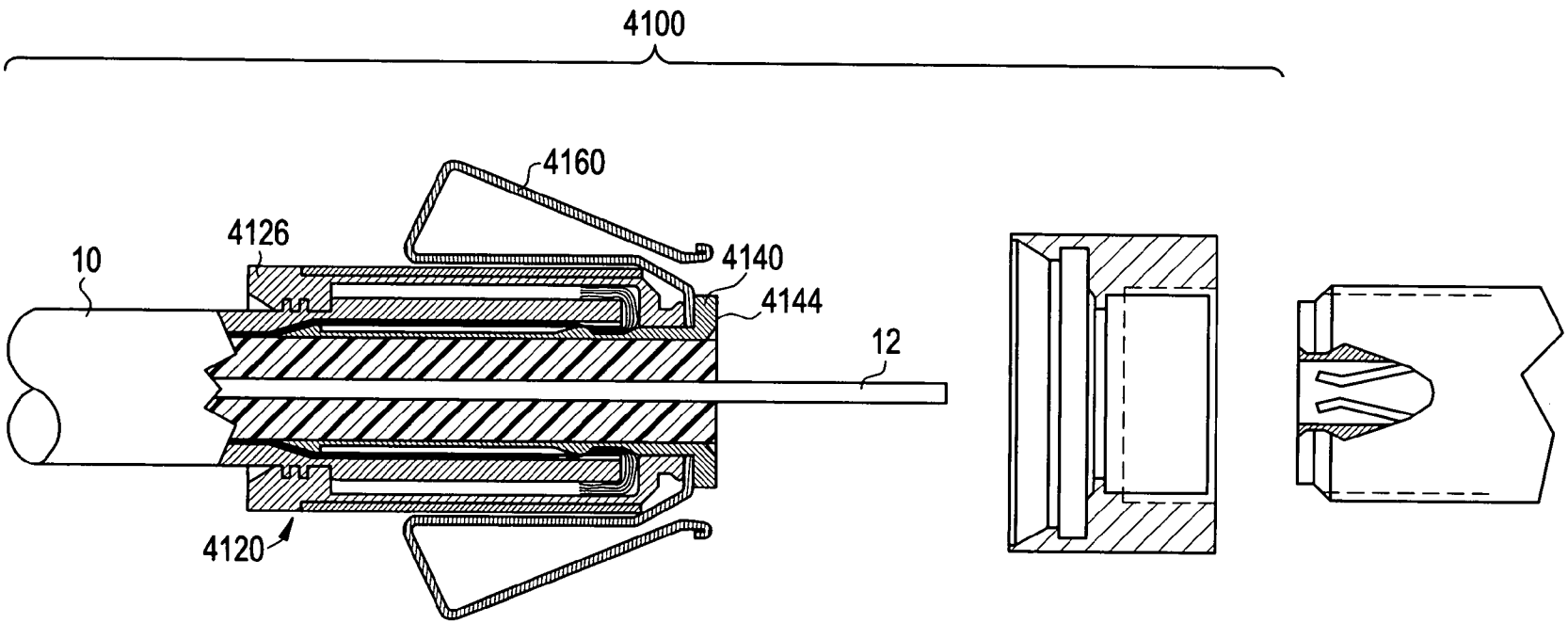
FIG. 15 shows the connector assembly of FIG. 14 with the connector member in the fully compressed state.

FIGS. 14 and 15 illustrate a connector member 4120 and post 4140 such as in FIGS. 12 and 13, but the locking member 4160 is configured to contact the outer surface of the post 4140, here the outer surface of the shank 4142. As understood from the uncompressed state shown in FIG. 14 and the compressed state shown in FIG. 15, the locking member 4160 is capable of sliding axially, with respect to the tubular body 4126 and with respect to the post 4140. The post flange 4144 limits forward movement of the locking member 4160, with respect to the tubular body 4126 and with respect to the post 4140. As best seen in FIG. 15, part of the locking member 4160 is sandwiched between the front end of the tubular body 4126 and the post flange 4144 in the fully compressed state.

Figure 16:
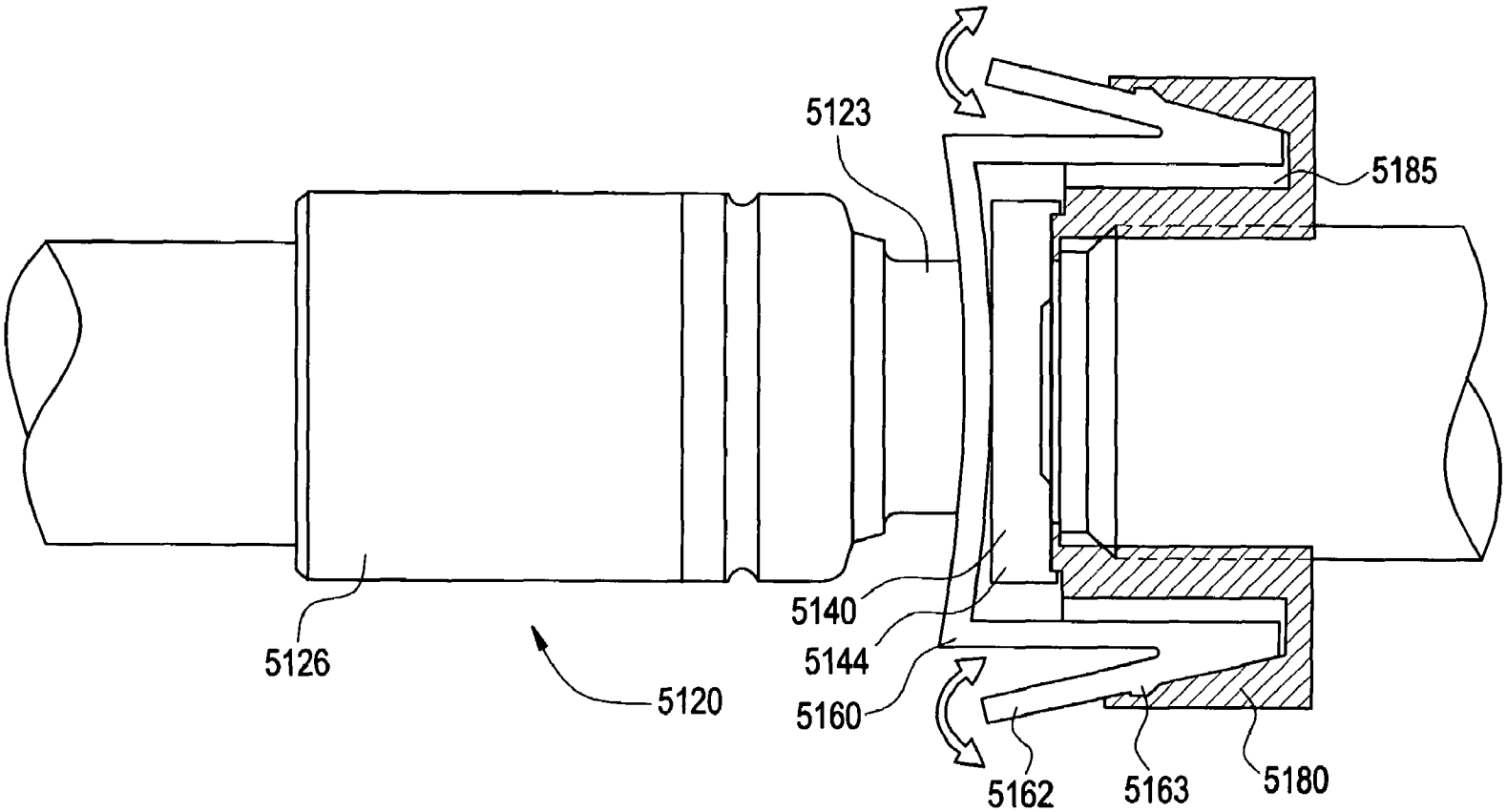
FIG. 16 shows yet another embodiment of the connector assembly disclosed herein.

FIG. 16 illustrates another embodiment of a connector assembly 5120 disclosed herein. The assembly comprises a tubular body 5126, a locking member 5160, a post 5140, and an adapter 5180. The locking member 5160 comprises two resilient arms 5162. The external surface of the adapter is 5180 provided with at least one external recess 5185 configured to receive the resilient arms 5162. The external recess 5185 faces backward. The resilient arms 5162 are biased radially outwardly and engage the external surface of the adapter 5180, thereby inhibiting disengagement between the connector member 5120 and the adapter 5180. Part of the locking member 5160 is disposed about a front portion 5123 of the tubular body 5126, and the post flange 5144 limits forward movement of the locking member 5160 relative to the post 5140 and relative to the tubular body 5126. The front face of the post flange 5144 and the rear face of the adapter 5180 are configured to mate with each other and contact each other. An outward protrusion 5163 on the arms 5162 engages a groove provided in the surface of the adapter 5180 to help resist the arms 5162 from disengaging from the adapter 5180.

Figure 17:
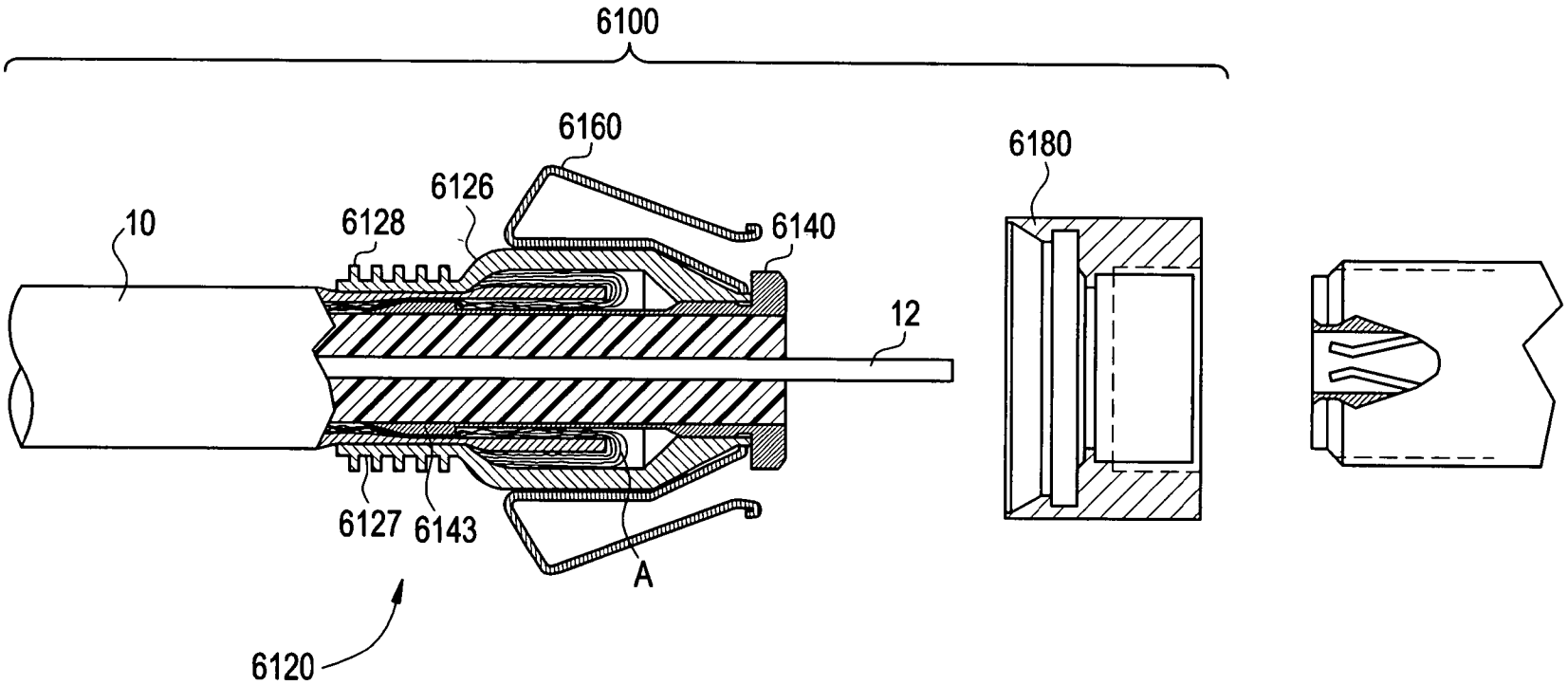
FIG. 17 shows yet another embodiment of the connector assembly disclosed herein, which has a crimpable portion.

FIG. 17 illustrates another embodiment of a connector assembly disclosed herein. The assembly comprises a tubular body 6126, a post 6140, a locking member 6160, and an adapter 6180. The tubular body 6126 comprises a crimpable portion 6127. As shown in the fully crimped state in FIG. 17, the post 6140 has been driven into the cable 400 under the braid. The front portion of the braid has been folded back over the jacket 402, and the front portion of the braid is disposed in the annular space A between the cable jacket 402 and the internal surface of the crimpable portion 6127 of the tubular body 6126 of the connector member 6120. In some embodiments, the post 6140 is fixedly attached to the tubular body 6126. The outer surface of the crimpable portion 6127 of the tubular body 6126 may comprise a plurality of external projections or ribs 6128 which are adapted to mate with a known crimping tool. Upon crimping of the crimpable portion 6127, the jacket and braid of the cable are sandwiched between the crimpable portion and the tubular post 6140. In some embodiments, the post 6140 and the tubular body 6126 are configured to cause at least part of the crimpable portion 6127 to surround at least part of a raised portion 6143, such as a wedge portion, of the post 6140, to allow compressing and gripping of the jacket and the braid between the raised portion 6143 and the crimpable portion 6127. Thus, the cable is gripped by the connector member 6120.

Figure 18:
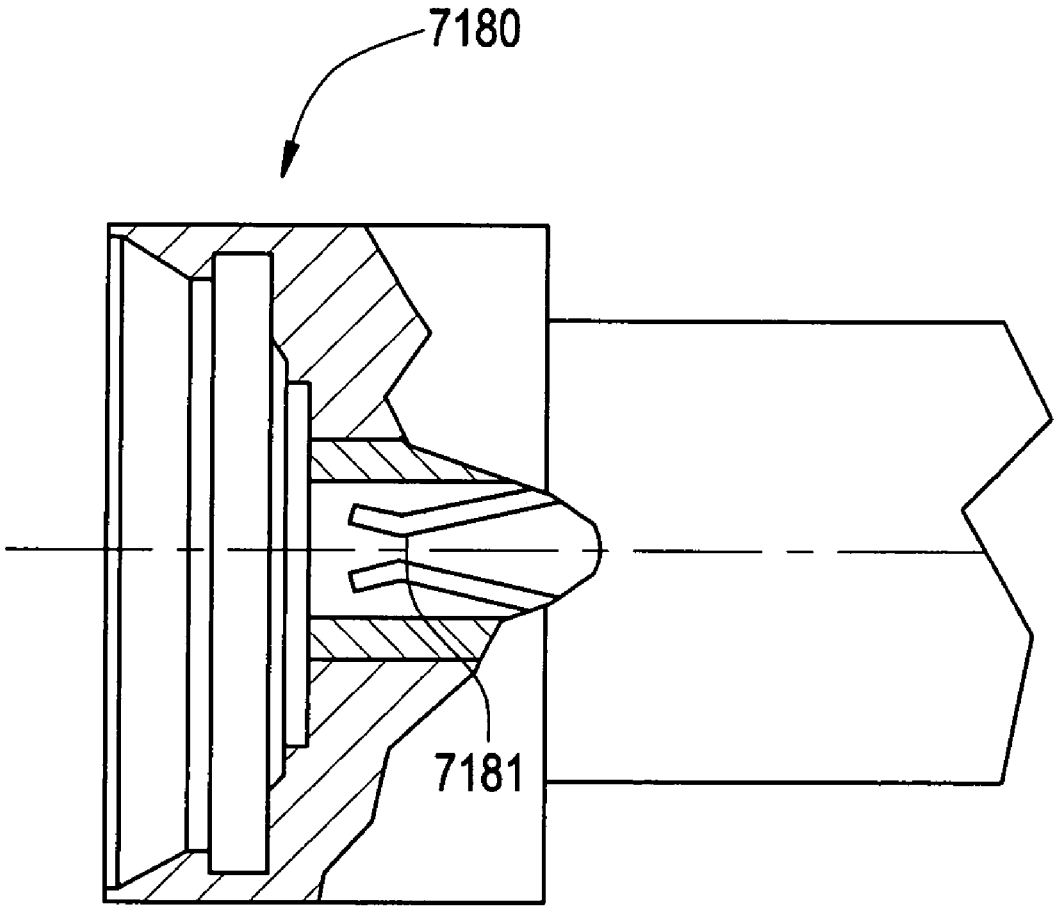
FIG. 18 shows another alternate embodiment of an adapter disclosed herein.

FIG. 18 illustrates another embodiment of an adapter 7180 comprising a center portion 7181 adapted to receive the center conductor of the cable. Such an adapter could take the place of a port.

What is claimed is:

1. A coaxial connector assembly for coupling a coaxial cable to a port, the assembly comprising:

a connector member comprising a front end, a back end, and an outer surface;

a post comprising:

a shank, at least partially disposed inside the connector member, the shank being configured for insertion into the cable, wherein the shank and the connector member are capable of sandwiching the cable; and a flange disposed outside the connector member;

a locking member disposed between the flange and the outer surface of the connector member, the locking member comprising at least two forward extending resilient arms; and an adapter comprising a front portion, a back portion, an external surface, and an internal surface defining a through hole extending from the front end to the back end of the adapter, wherein the front portion of the adapter is configured to engage the port, and the back portion of the adapter is configured to receive the connector member, and wherein the resilient arms are configured to snap fit into the adapter, thereby releasably attaching the connector member to the adapter.

2. The connector of claim 1 wherein the at least two forward extending resilient arms comprise at least one pair of opposed forward extending resilient arms.

3. The connector of claim 1 wherein the connector member comprises a tubular body.

4. The connector of claim 1 wherein the locking member contacts the connector member.

5. The connector of claim 4 wherein the locking member comprises electrically conductive material, thereby providing an electrical path from the connector member to the adapter.

6. The connector of claim 1 wherein the shank is configured for insertion between a dielectric and an outer conductor of the cable.

7. The connector of claim 1 wherein the connector member comprises a crimpable portion capable of being crimped toward the shank of the post.

8. The connector of claim 1 wherein the post is provided with a through hole configured to allow a center conductor of the cable to protrude through the post and beyond the flange.

9. The connector of claim 8 wherein a center portion of the port receives the center conductor of the cable, thereby electrically connecting the center portion of the port and the center conductor of the cable.

10. The connector of claim 1 wherein the adapter is configured to threadably engage the port.

11. The connector of claim 1 wherein the locking member and the adapter contact each other to form an electrical path between the outer surface of the connector body and an outer surface of the port.

12. The connector of claim 1 wherein the internal surface of the adapter is provided with an internal recess configured to receive at least one of the resilient arms.

13. The connector of claim 12 wherein the resilient arms are biased radially outwardly and engage the internal surface of the adapter.

14. The connector of claim 1 wherein the locking member is trapped between the flange of the post and the connector member.

15. A combination of a coaxial cable and a coaxial connector assembly for coupling the coaxial cable to a port, the coaxial cable comprising a center conductor, wherein the assembly comprises:

a connector member comprising a front end, a back end, and an outer surface;

a post comprising:

a shank inserted into the cable, at least part of the shank being disposed inside the connector member, wherein at least part of the cable is sandwiched between the shank and the connector member, thereby securing the cable to the connector member; and a flange disposed outside the connector member, wherein the center conductor of the cable protrudes forwardly beyond the flange;

a locking member disposed between the flange and the outer surface of the connector member, the locking member comprising at least one pair of opposed forward extending resilient arms, wherein the center conductor of the cable protrudes through the locking member; and an adapter comprising a front portion, a back portion, an external surface, and an internal surface defining a through hole extending from the front end to the back end of the adapter;

wherein the front portion of the adapter is configured to engage the port, wherein the connector member is received in the back portion of the adapter, and wherein the resilient arms are snap fit onto the adapter, thereby releasably attaching the connector member to the adapter.

16. The connector of claim 15 wherein the locking member contacts the connector member.

17. The connector of claim 15 wherein the resilient arms are biased radially inwardly.

18. The connector of claim 15 wherein the resilient arms are biased radially outwardly.

19. The connector of claim 15 wherein the post is provided with a through hole, and wherein a portion of the cable is disposed within the through hole, and wherein the center conductor of the cable extends through the post and beyond the flange.

20. The connector of claim 15 wherein the locking member is trapped between the flange of the post and the connector member.

* * * * *